US008677866B2

(12) United States Patent
Steele et al.

(10) Patent No.: US 8,677,866 B2
(45) Date of Patent: Mar. 25, 2014

(54) PLIERS INCLUDING REMOVABLE JAWS

(71) Applicant: Milwaukee Electric Tool Corporation, Brookfield, WI (US)

(72) Inventors: Michael S. Steele, Waukesha, WI (US); Wade Burch, Wauwatosa, WI (US); Tim Albrecht, Menomonee Falls, WI (US); Michael W. Phillips, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 13/939,716

(22) Filed: Jul. 11, 2013

(65) Prior Publication Data

US 2013/0291692 A1 Nov. 7, 2013

Related U.S. Application Data

(63) Continuation of application No. 13/005,083, filed on Jan. 12, 2011, now Pat. No. 8,516,931.

(60) Provisional application No. 61/294,287, filed on Jan. 12, 2010, provisional application No. 61/330,794, filed on May 3, 2010, provisional application No. 61/367,731, filed on Jul. 26, 2010.

(51) Int. Cl.
*B25B 7/04* (2006.01)

(52) U.S. Cl.
USPC ..... 81/414; 81/185.1; 81/423; 72/413

(58) Field of Classification Search
USPC ..... 81/385, 414, 418–426.5, 180.1–185.2; 269/271, 43; 29/268
See application file for complete search history.

(56) References Cited

U.S. PATENT DOCUMENTS

| | | | |
|---|---|---|---|
| 236,617 | A | 1/1881 | Paul |
| 334,862 | A | 1/1886 | Harmon |
| 929,868 | A | 8/1909 | Mueller |
| 1,413,769 | A | 4/1922 | O'Reardon |

(Continued)

FOREIGN PATENT DOCUMENTS

| | | |
|---|---|---|
| GB | 181250 | 6/1922 |
| GB | 597160 | 1/1948 |

(Continued)

OTHER PUBLICATIONS

International Search Report and Written Opinion for Application No. PCT/US2011/020947 dated Sep. 29, 2011 (11 pages).

*Primary Examiner* — Monica Carter
*Assistant Examiner* — Melanie Alexander
(74) *Attorney, Agent, or Firm* — Michael Best & Friedrich LLP

(57) ABSTRACT

A pliers that includes a jaw member removably coupled to a head of the pliers. The jaw member includes a grip surface and a flange including an aperture. The pliers further includes a fastener that extends into the aperture of the flange and an aperture of a longitudinal side of the head to removably couple the jaw member to the head. The jaw member is slidable along the jaw surface of the head from the first longitudinal side toward the second longitudinal side to uncouple the jaw member from the head when the fastener is uncoupled from at least one of the jaw member and the head.

20 Claims, 5 Drawing Sheets

(56) References Cited

U.S. PATENT DOCUMENTS

| | | | |
|---|---|---|---|
| 1,522,695 | A | 1/1925 | Noreen |
| 1,556,755 | A | 10/1925 | Burman |
| 1,902,913 | A | 3/1933 | Sievern |
| 2,011,622 | A | 8/1935 | Erickson et al. |
| 2,531,522 | A | 11/1950 | Malouf |
| 2,572,237 | A | 10/1951 | Andrews |
| 2,606,471 | A | 8/1952 | Kollweck |
| 2,645,146 | A | 7/1953 | Matter |
| 2,725,774 | A | 12/1955 | Tekse |
| 2,748,641 | A | 6/1956 | Calello |
| 2,762,380 | A | 9/1956 | Strickland |
| 2,777,348 | A | 1/1957 | Wraight |
| 2,814,222 | A | 11/1957 | Sanders |
| 2,820,385 | A | 1/1958 | Schulze |
| 3,176,551 | A | 4/1965 | Hansen |
| 3,635,107 | A | 1/1972 | Schmidt |
| 3,760,473 | A | 9/1973 | Studdard |
| 3,921,237 | A | 11/1975 | Steiner |
| 3,947,904 | A | 4/1976 | Hayes |
| 4,104,752 | A | 8/1978 | Amrein et al. |
| 4,315,447 | A | 2/1982 | Tartaglia et al. |
| 4,381,661 | A | 5/1983 | Wiener |
| 4,403,497 | A | 9/1983 | Matteucci |
| 4,539,873 | A | 9/1985 | Freed |
| 4,813,310 | A | 3/1989 | Moynihan |
| 4,905,550 | A | 3/1990 | Albrecht |
| 5,113,727 | A | 5/1992 | Foster |
| 5,255,579 | A | 10/1993 | Fortin |
| 5,497,522 | A | 3/1996 | Chen |
| 5,572,899 | A | 11/1996 | Balaity |
| 5,575,029 | A | 11/1996 | Simpson |
| 5,715,604 | A | 2/1998 | Lanzoni |
| 6,053,025 | A | 4/2000 | Beetz |
| 6,311,588 | B1 | 11/2001 | St. John et al. |
| 6,336,386 | B1 | 1/2002 | Lee |
| 6,464,704 | B2 | 10/2002 | Schmaltz et al. |
| 6,707,007 | B1 | 3/2004 | Siddoway |
| 6,718,851 | B1 | 4/2004 | Peggion |
| 6,725,486 | B2 | 4/2004 | Oka |
| 7,162,758 | B2 | 1/2007 | Skinner |
| 7,313,989 | B1 | 1/2008 | Tortolani, Jr. |
| 7,676,873 | B1 | 3/2010 | Simms |
| 8,516,931 | B2 | 8/2013 | Steele et al. |
| 2005/0166721 | A1* | 8/2005 | Bollinger ..... 81/185.1 |
| 2007/0221016 | A1 | 9/2007 | Herbst et al. |
| 2009/0308132 | A1 | 12/2009 | Lai et al. |

FOREIGN PATENT DOCUMENTS

| | | |
|---|---|---|
| KR | 2020100004095 | 4/2010 |
| WO | 2009012517 | 1/2009 |
| WO | 2009072907 | 6/2009 |
| WO | 2011088087 | 7/2011 |

* cited by examiner 110
140
150
146
114
112
118
138
144
206
208
124
148
5
5
210
214
212
216
184
185b
180
182
185a
234
186
230
236
232

PLIERS INCLUDING REMOVABLE JAWS

CROSS-REFERENCE TO RELATED APPLICATIONS

This application is a continuation of prior-filed, co-pending U.S. patent application Ser. No. 13/005,083, filed Jan. 12, 2011, which claims priority to U.S. Provisional Patent Application Nos. 61/294,287, filed Jan. 12, 2010, 61/330,794, filed May 3, 2010, and 61/367,731, filed Jul. 26, 2010, the entire contents all of which are hereby incorporated by reference herein.

BACKGROUND

The present invention relates to pliers, and more particularly to pliers that include removable jaws.

Pliers typically include jaws and a handle. The handle often includes two levers that are rotated relative to each other about a pivot to open or close the jaws. The jaws are opened and closed to grip components, such as pipes, bars, other work-pieces, and the like or hardware, such as, nuts, bolts, other fasteners and the like. Often, the jaws include a gripping surface that can become worn. Also, a user may desire jaws having a particular gripping surface for a particular application.

SUMMARY

In one embodiment, the invention provides a pliers that includes a head including a first longitudinal side and a second longitudinal side having an aperture, and the second longitudinal side is generally opposed to the first longitudinal side. The head further includes a first grip surface and a jaw surface generally perpendicular to the first and the second longitudinal sides and adjacent the first and the second longitudinal sides. The pliers further includes a handle configured to rotate the head, a jaw member removably coupled to the head, and the jaw member includes a second grip surface. The second grip surface is movable with respect to the first grip surface to adjust the pliers. The jaw member further includes a flange including an aperture. The pliers further includes a fastener that extends into the aperture of the flange and the aperture of the second side surface to removably couple the jaw member to the head. The jaw member is slidable along the jaw surface of the head from the first longitudinal side toward the second longitudinal side to uncouple the jaw member from the head when the fastener is uncoupled from at least one of the jaw member and the head.

In another embodiment the invention provides a pliers including a head having a first groove and a second groove. The pliers further includes a handle configured to rotate the head and a first jaw member removably coupled to the head. The first jaw member includes a grip surface, a projection received in the first groove in a first orientation to couple the first jaw member to the head and the projection received in the first groove in a second orientation to couple the first jaw member to the head to place the grip surface in a different position with respect to the head than in the first orientation, a first aperture, and a second aperture. The pliers further includes a second jaw member removably coupled to the head. The second jaw member includes a grip surface, a projection received in the second groove in a first orientation to couple the second jaw member to the head and the projection received in the second groove in a second orientation to couple the second jaw member to the head to place the grip surface of the second jaw member in a different position with respect to the head than in the first orientation of the second jaw member, a first aperture, and a second aperture. The pliers further includes a first fastener that extends into the first aperture of the first jaw member to removably couple the first jaw member to the head in the first orientation of the first jaw member and the first fastener extends into the second aperture of the first jaw member to removably couple the first jaw member to the head in the second orientation of the first jaw member. The pliers further includes a second fastener that extends into the first aperture of the second jaw member to removably couple the second jaw member to the head in the first orientation of the second jaw member and the second fastener extends into the second aperture of the second jaw member to removably couple the second jaw member to the head in the second orientation of the second jaw member.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
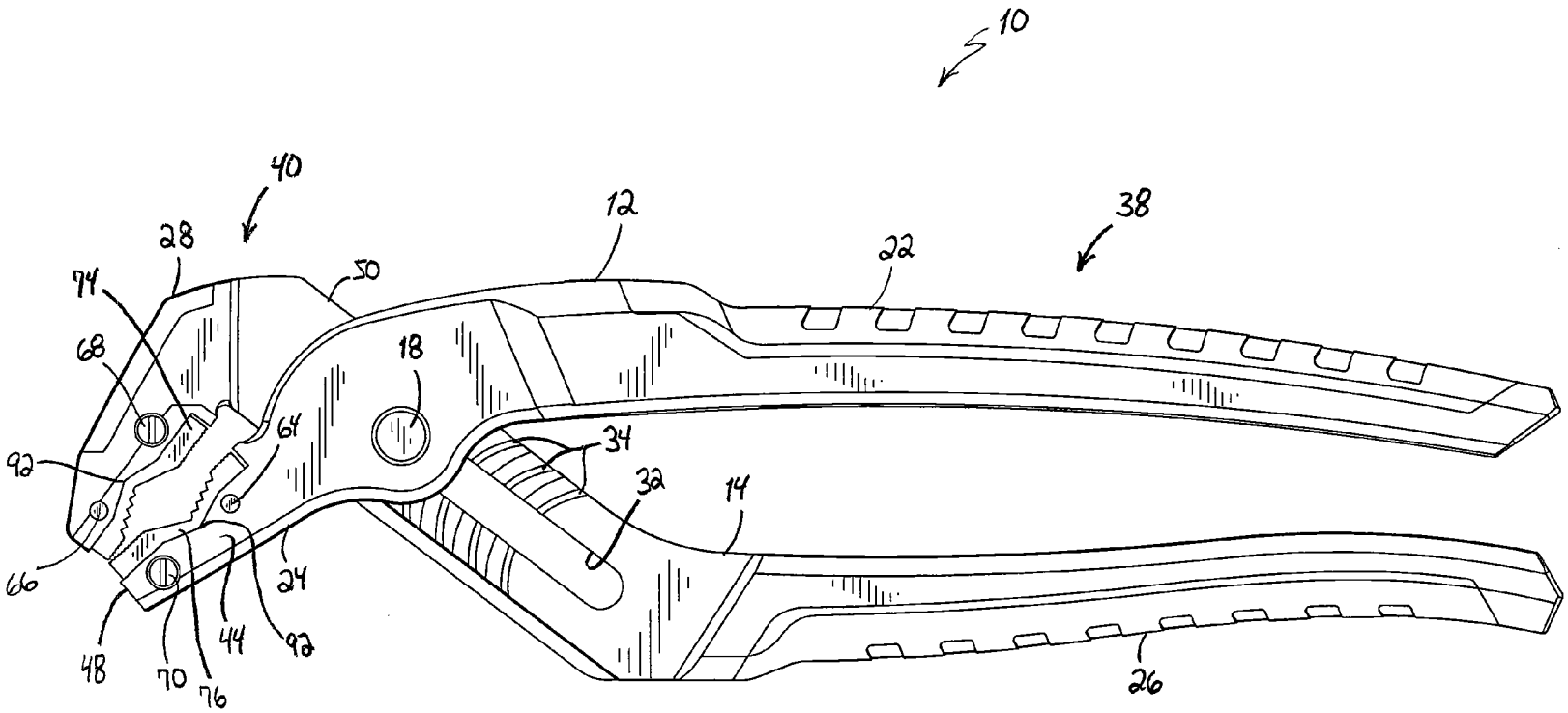
FIG. 1 is a side view of a pliers according to one embodiment of the invention.

FIG. 1 illustrates a pliers 10 according to one embodiment of the invention. The pliers 10 includes a first member 12 and a second member 14 that is pivotally connected to the first member 12 via a pin 18. The first member 12 includes a handle portion 22 and a head portion 24. The second member 14 includes a handle portion 26 and a head portion 28. A slot 32 is located in the second member 14 between the handle portion 26 and the head portion 28. Grooves 34 are located adjacent the slot 32. The pin 18 is received in the slot 32 to couple the first member 12 and the second member 14 and the grooves 34 are used to position the first member 12 with respect to the second member 14. Accordingly, the illustrated pliers 10 is a tongue and groove pliers. However, in other embodiments, the pliers may be another type, such as locking pliers, adjustable pliers, slip joint pliers, etc.

Together the handle portion 22 of the first member 12 and the handle portion 26 of the second member 14 define a handle 38 of the pliers 10, and the head portion 24 of the first member 12 and the head portion 28 of the second member 14 define a head 40 of the pliers 10. The handle 38 is configured to be grabbed by a user to rotate the head 40 of the pliers 10.

Figure 2:
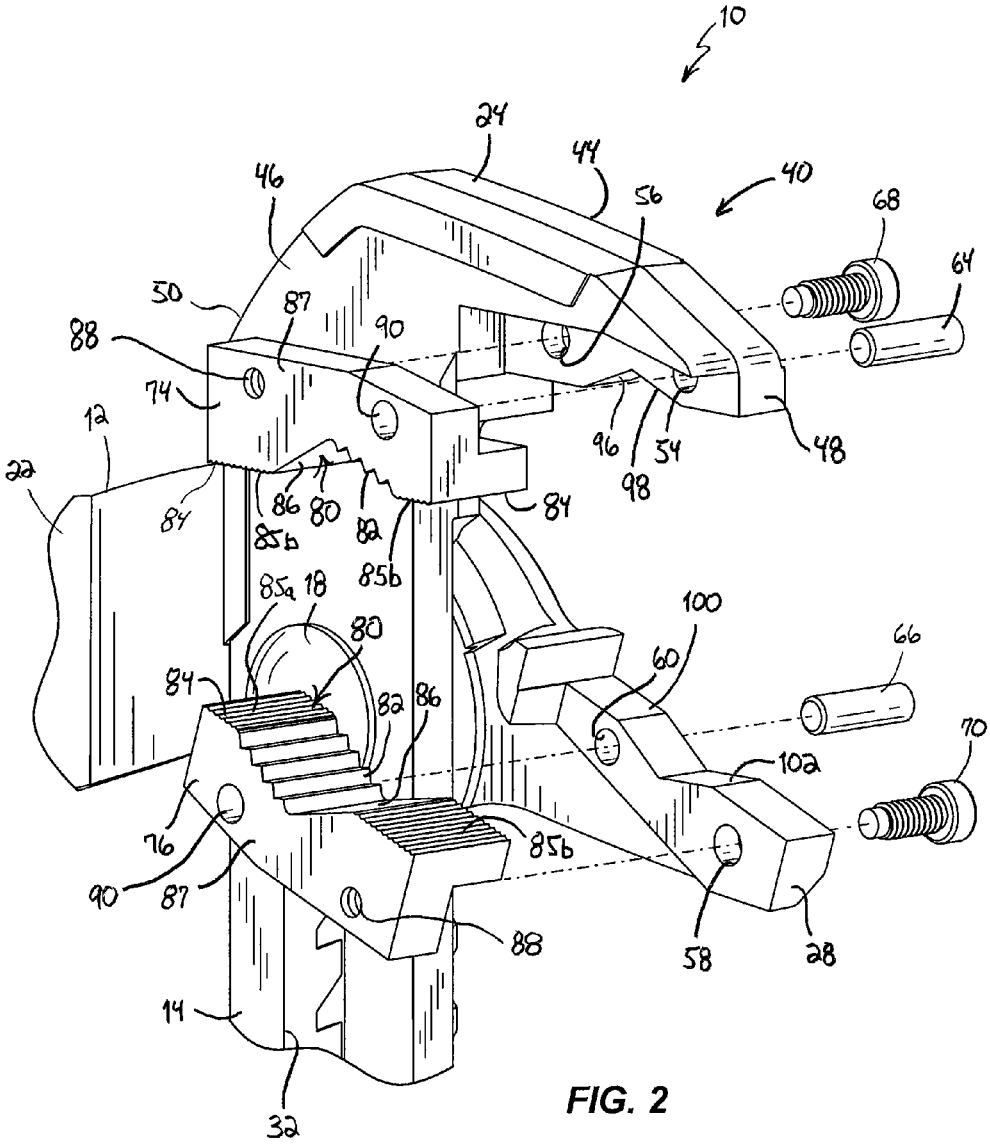
FIG. 2 is an exploded view of a portion of the pliers of FIG. 1.

Referring to FIGS. 1 and 2, the head 40 includes a first longitudinal side 44 and a second longitudinal side 46 that faces in a directly opposite direction than the first longitudinal side 44. A front side 48 of the head 40 connects the first side 44 and the second side 46 of the head 40. A rear side 50 connects the first side 44 and the second side 46 opposite the front side 48. Apertures 54, 56, 58, 60 extend through the head 40 between the first side 44 and the second side 46. Apertures 54 and 60 are sized to each receive a pin 64 and 66, respectively, such that the apertures 54, 60 retain the pins via an interference fit, adhesives, or the like and the pins 64, 66 extend outwardly from the side 46 of the head 40. Apertures 56 and 58 are sized to each receive a fastener 68 and 70, respectively, such that the fasteners 68, 70 can rotate within the respective aperture 56, 58. In the illustrated embodiment, the fasteners 68, 70 are both threaded fasteners, more specifically, screws.

The pliers 10 further includes a first jaw member 74 and a second jaw member 76 that are both removably coupled to the head 40 of the pliers 10. The first jaw 74 and the second jaw 76 are identical components in the illustrated embodiment such that jaws 74, 76 are manufactured as the same or one component. Further, the first jaw 74 may be used in place of the second jaw 76 and vice-versa. Therefore, only the first jaw 74 will be described in detail and like components have been give the same reference number.

The jaw 74 includes a grip surface 80. The grip surface 80 includes a first grip profile 82 and a second grip profile 84. The first grip profile 82 includes relatively large teeth and the second grip profile 84 includes relatively small teeth. The second grip profile 84 includes a first portion 85*a* and a second portion 85*b* that are generally co-planar. The first grip profile 82 is disposed at an angle with respect to the first portion 85*a* and the second portion 85*b*, and the second grip profile 84 is between the first portion 85*a* and the second portion 85*b*. The grip surface 80 further includes a third grip profile 86 that is relatively smooth and includes no teeth. The third grip profile 86 is disposed at an angle with respect to the second grip profile 84 such that the first grip profile 82 and the third grip profile 86 form a generally V-shape between the first portion 85*a* and the second portion 85*b* of the second grip profile 84.

A flange 87 extends from the grip surface 80 in a perpendicular direction with respect to the grip surface 80. A first aperture 88, which is a threaded aperture in the illustrated embodiment, extends through the flange 87 and is configured to receive the fastener 68. A second aperture 90 extends through the flange 87 and is configured to receive the pin 64. The jaw 74 further includes a V-shaped projection 92 (FIG. 1).

Referring to FIGS. 1 and 2, the head 40 further includes a first jaw surface 96. The first jaw surface 96 is generally perpendicular to the first side 44 and the second side 46 of the head 40, and the first jaw surface 96 is adjacent the sides 44, 46. A V-shaped groove 98, which includes a portion of the jaw surface 96, extends from the first side 44 of the head 40 to the second side 46 of the head 40. The V-shaped groove 98 is sized to mate tightly with the V-shaped projections 92 of the jaws 74, 76. The head 40 further includes a second jaw surface 100 that faces the first jaw surface 96. The second jaw surface 100 is also perpendicular to the first side 44 and the second side 46 of the head 40, and the second jaw surface 100 is adjacent the sides 44, 46. A V-shaped groove 102, which includes a portion of the second jaw surface 100, extends from the first side 44 of the head 40 to the second side 46 of the head 40. The V-shaped groove 100 is sized to mate tightly with the V-shaped projections 92 of the jaws 74, 76.

In operation, to couple the first jaw 74 to the head 40 of the pliers 10, the user inserts the pin 64 through the aperture 90 in the jaw 74 and the user slides the V-shaped projection 92 of the jaw 74 along the first jaw surface 96 of the head 40 from the second side 46 of the head 40 toward the first side 44. Then, the user aligns the threaded aperture 88 of the jaw 74 with the aperture 56 of the head 40 that is configured to receive the screw 68. Next, the user rotates or tightens the screw 68 to draw the flange 87 firmly in contact with the second side 46 of the head 40 and firmly hold the jaw 74 in position. If the user desires to remove the jaw 74, the user loosens the screw 68 or uncouples the screw 68 from the jaw 74 and slides the jaw 74 off of the pin 64 and the jaw surface 96. The second jaw 76 is similarly coupled and uncoupled from the head 40.

Figure 3:
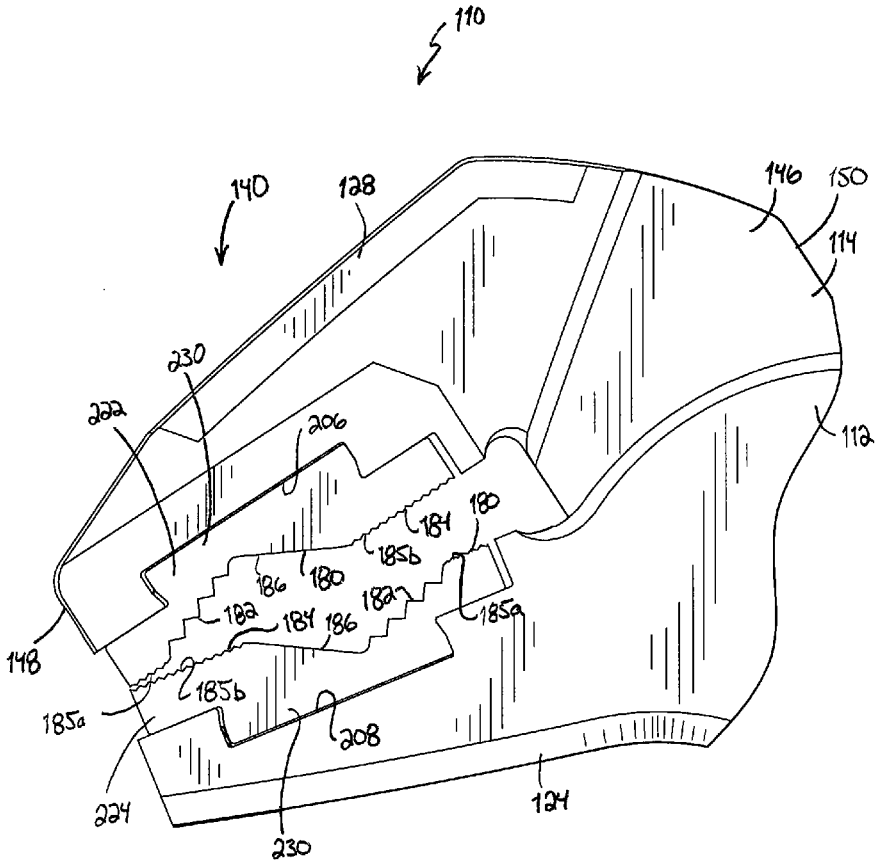
FIG. 3 is a side view of a pliers according to another embodiment of the invention.
Figure 4:
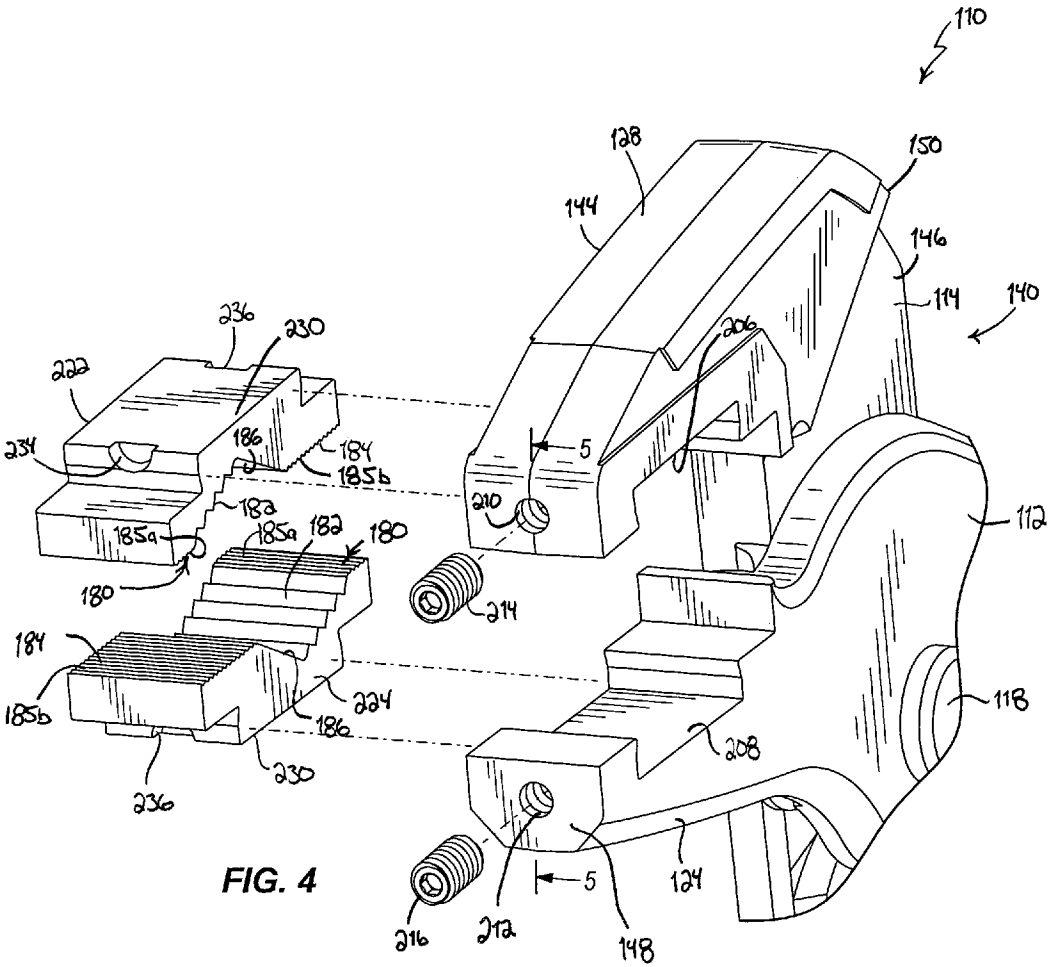
FIG. 4 is an exploded view of the pliers of FIG. 3.
Figure 5:
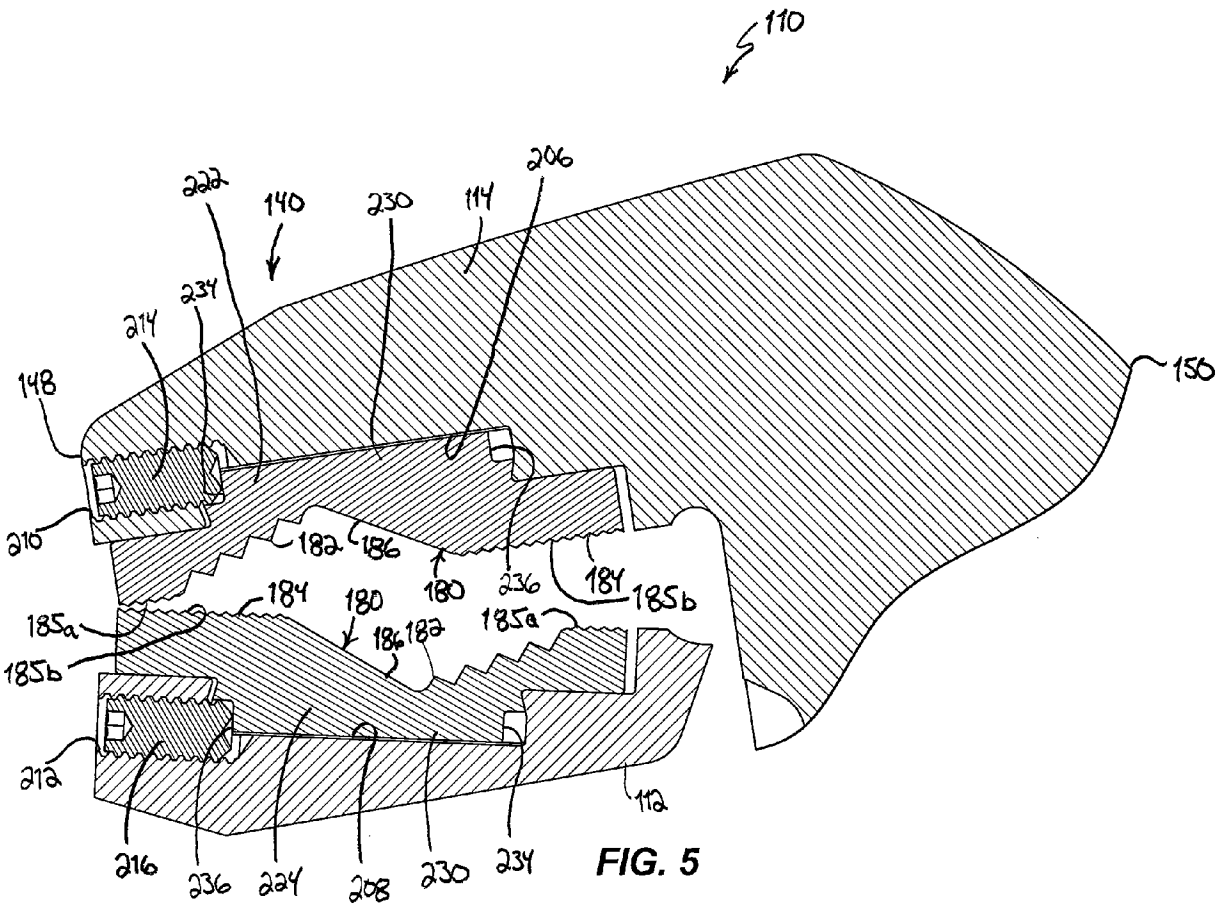
FIG. 5 is a cross-sectional view of the pliers of FIG. 3 taken along line 5-5 of FIG. 4.

FIGS. 3-5 illustrate a pliers 110 according to another embodiment. The pliers 110 is similar to the pliers 10 illustrated in FIGS. 1-2 and described above. Accordingly, only differences between the pliers 10 and 110 will be discussed in detail herein and like components have been given like reference numbers plus 100.

Referring to FIG. 4, the pliers 110 includes a head 140 including a first groove 206 and a second groove 208. The first groove 206 and the second groove 208 are both dovetail-shaped, and in the illustrated embodiment, the grooves 206, 208 have the same dimensions. A first aperture 210 extends through a front side 148 of the head 140 and into the first groove 206. A second aperture 212 extends through the front side 148 of the head 140 and into the second groove 208. Both the apertures 210, 212 are threaded in the illustrated embodiment. A first fastener 214, which is a screw in the illustrated embodiment, is received in the first aperture 210, and a second fastener 216, which is also a screw in the illustrated embodiment, is received in the second aperture 212.

A first jaw member 222 and a second jaw member 224 are both removably coupled to the head 140. The first jaw 222 and the second jaw 224 are identical components in the illustrated embodiment such that jaws 222, 224 are manufactured as the same or one component. Further, the first jaw 222 may be used in place of the second jaw 224 and vice-versa. Therefore, only the first jaw 222 will be described in detail and like components have been give the same reference numbers.

The jaw 222 includes a grip surface 180. The grip surface 180 includes a first grip profile 182 disposed at an angle and having relatively large teeth and a second grip profile 184 that is relatively flat and includes relatively small teeth. The jaw 222 further includes a projection 230. The illustrated projection 230 is dovetail-shaped and sized to be received in either of the grooves 206, 208. The projection 230 includes a first aperture 234 that opens facing a first direction and a second aperture 236 that opens facing a second direction that is directly opposed or 180 degrees from the first direction of the first aperture 234.

In operation, to couple the jaw 222 to the head 140, the user slides the projection 230 into either groove 206, 208 from a first longitudinal side 146 of the head 140 toward a second longitudinal side 144 of the head 140 or vice-versa. With the projection received in one of the grooves 206, 208, the user rotates the corresponding screw 214, 216 so that the screw 214, 216 extends into the corresponding groove 206, 208 is received in one of the apertures 234, 236 (FIG. 5). With the two apertures 234, 236, the user can position the grip profiles 182, 184 in different orientations with respect to the head 140. To uncouple the jaw 222, the user rotates the screw 214, 216 so that it is no longer received in the aperture 234, 236, which allows the user to slide the jaw 222 out of the groove 206, 208. The second jaw 224 is similarly coupled and uncoupled from the head 140.

Thus, the invention provides, among other things, a pliers having removable jaws where the jaws are easily removed and attached to a head of the pliers. Various features and advantages of the invention are set forth in the following claims.

What is claimed is:

1. A pliers comprising:

a head including, a first groove, a second groove, a handle configured to rotate the head;

a first jaw member removably coupled to the head, the first jaw member including, a grip surface, a projection received in the first groove in a first orientation to couple the first jaw member to the head and in a second orientation to couple the first jaw member to the head to place the grip surface in a different position with respect to the head than in the first orientation, a first aperture, and a second aperture, a second jaw member removably coupled to the head, the second jaw member including, a grip surface, a projection received in the second groove in a first orientation to couple the second jaw member to the head and in a second orientation to couple the second jaw member to the head to place the grip surface of the second jaw member in a different position with respect to the head than in the first orientation of the second jaw member, a first aperture, and a second aperture, a first fastener that extends into the first aperture of the first jaw member to removably couple the first jaw member to the head in the first orientation of the first jaw member and the first fastener extends into the second aperture of the first jaw member to removably couple the first jaw member to the head in the second orientation of the first jaw member; and a second fastener that extends into the first aperture of the second jaw member to removably couple the second jaw member to the head in the first orientation of the second jaw member and the second fastener extends into the second aperture of the second jaw member to removably couple the second jaw member to the head in the second orientation of the second jaw member.

2. The pliers of claim 1, wherein the head further includes, a first longitudinal side, and a second longitudinal side generally opposed to the first longitudinal side, wherein the first groove extends from the first longitudinal side to the second longitudinal side.

3. The pliers of claim 2, wherein the projection of the first jaw member is slidable within the first groove from the first longitudinal side toward the second longitudinal side.

4. The pliers of claim 3, wherein the head further includes, a front side that connects the first longitudinal side and the second longitudinal side, a rear side that connects the first longitudinal side and the second longitudinal side opposite the front side, a first aperture that extends through the front side, wherein the first fastener is received in the first aperture and extends into the first groove.

5. The pliers of claim 1, wherein the projection of the first jaw member includes a dovetail projection.

6. The pliers of claim 1, wherein the first jaw member and the second jaw member are substantially identical components.

7. The pliers of claim 1, wherein the first fastener is a threaded fastener, and wherein the second fastener is a threaded fastener.

8. The pliers of claim 1, wherein the projection of the first jaw member includes the first and the second apertures of the first jaw member.

9. The pliers of claim 1, wherein the first aperture of the first jaw member opens toward a first direction, and wherein the second aperture of the first jaw member opens toward a second direction directly opposed to the first direction.

10. The pliers of claim 9, wherein the projection of the first jaw member is slidable within the first groove in a third direction that is substantially perpendicular to the first direction.

11. A pliers comprising:

a head including a first groove and a second groove, a handle configured to rotate the head;

a first jaw member removably received within the first groove in a first orientation with respect to the head, the first jaw member configured to be positioned within the first groove in a second orientation with respect to the head, the first jaw member including a grip surface, a first aperture, and a second aperture;

a second jaw member removably received within the second groove in a first orientation with respect to the head, the second jaw member configured to be positioned within the second groove in a second orientation with respect to the head, the second jaw member including a grip surface, a first aperture, and a second aperture;

a first fastener engaging the first aperture of the first jaw member to secure the first jaw member to the head in the first orientation; and a second fastener engaging the first aperture of the second jaw member to secure the second jaw member to the head in the first orientation, wherein the first fastener engages the second aperture of the first jaw member when the first jaw member is positioned within the first groove in the second orientation to secure the first jaw member to the head, wherein the second fastener engages the second aperture of the second jaw member when the second jaw member is positioned within the second groove in the second orientation to secure the second jaw member to the head.

12. The pliers of claim 11, wherein the head further includes, a first longitudinal side, and a second longitudinal side generally opposed to the first longitudinal side, wherein the first groove extends from the first longitudinal side to the second longitudinal side.

13. The pliers of claim 12, wherein the first jaw member is slidable within the first groove from the first longitudinal side toward the second longitudinal side.

14. The pliers of claim 13, wherein the head further includes, an end surface extending between the first longitudinal side and the second longitudinal side, a first aperture extending through the end surface, wherein the first fastener is removably received in the first aperture and extends into the first groove.

15. The pliers of claim 11, wherein the first jaw member includes a dovetail projection that is slidable within the first groove to removably couple the first jaw member to the head.

16. The pliers of claim 11, wherein the first jaw member and the second jaw member are substantially identical components.

17. The pliers of claim 11, wherein the first fastener is a threaded fastener, and wherein the second fastener is a threaded fastener.

18. The pliers of claim 11, wherein the first aperture of the first jaw member opens toward a first direction, and wherein the second aperture of the first jaw member opens toward a second direction directly opposed to the first direction.

19. The pliers of claim 18, wherein the first jaw member is slidable within the first groove in a third direction that is substantially perpendicular to the first direction.

20. The pliers of claim 11, wherein the grip surface of the first jaw member is asymmetric such that positioning the first jaw member in the first orientation provides a first grip profile and positioning the first jaw member in the second orientation provides a second grip profile that is different from the first grip profile.

* * * * *